US005342060A

United States Patent [19]

Barkus

[11] Patent Number: 5,342,060

[45] Date of Patent: Aug. 30, 1994

[54] BOARD GAME PLAYING PIECE AND METHOD OF PLAY

[76] Inventor: Steven C. Barkus, 234 Newhouse La., Round Lake Park, Ill. 60073

[21] Appl. No.: 91,310

[22] Filed: Jul. 14, 1993

[51] Int. Cl.[5] ..... A63F 7/00

[52] U.S. Cl. ..... 273/288

[58] Field of Search ..... 273/264, 271, 283, 288, 273/290, 291

[56] References Cited

U.S. PATENT DOCUMENTS

| | | | |
|---|---|---|---|
| 943,435 | 12/1909 | Maris | 273/288 |
| 2,571,195 | 10/1951 | Buck | 273/288 |
| 3,608,902 | 9/1971 | Weisbecker | 273/288 X |
| 4,673,185 | 6/1987 | Morley, Jr. | 273/288 X |
| 4,925,194 | 5/1990 | Anderson | 273/288 X |

*Primary Examiner*—William E. Stoll

[57] ABSTRACT

A game primarily comprised of four sided playing pieces marked with six different patterns of four distinct indicia. Each playing piece will be identical in shape and size and will have the unique property of having a concealed surface on each of the four sides that will be visible to only one player at one time. A challenge is presented when each player attempts to recreate a pattern of indicia visible to them using the same pieces that the other players are also using at the same time on a common playing surface.

2 Claims, 4 Drawing Sheets

BOARD GAME PLAYING PIECE AND METHOD OF PLAY

BACKGROUND—FIELD OF INVENTION

This invention relates generally to a board game, and more particularly to a board game using three dimensional playing pieces.

BACKGROUND—DESCRIPTION OF PRIOR ART

Board games utilizing playing pieces are numerous and well known in the art. However, a game using four sided pieces that are marked differently on each of the four sides and appear to each player differently than they appear to the other players has not been previously shown. Therefore, a game that utilizes game pieces which are visible only one or two sides at a time, with the pattern of the game pieces representing a particular players' view of the game at any one time is needed. The most unique property of this game that has not been previously demonstrated is that the game pieces will form a totally different pattern for each individual player based upon that players' perspective. Also all players have equal control of piece movement and rotation, rather than one person controlling a particular piece or set of pieces. Unlike most games currently on the market where tile playing field appears the same to all the players and in most cases each player controls one set of pieces.

OBJECTS AND ADVANTAGES

The present invention is comprised of a number of free standing four sided playing pieces. Each playing piece is marked in one of six possible patterns with one of four distinct indicia on each side. Each playing piece will have tile characteristic of having a limited number of indicia visible from each of the playing positions situated around the playing surface. The game can be played using any number of playing pieces that can be situated in any pattern either with or without a game board. The preferred number of playing pieces is twelve and should increase in increments of six. The game can be played in a competitive or cooperative manner with each player trying to arrange all the playing pieces in the pattern that has been recorded after previous random distribution of the playing pieces.

DESCRIPTION OF FIGS. 1 TO 4

Figure 1:
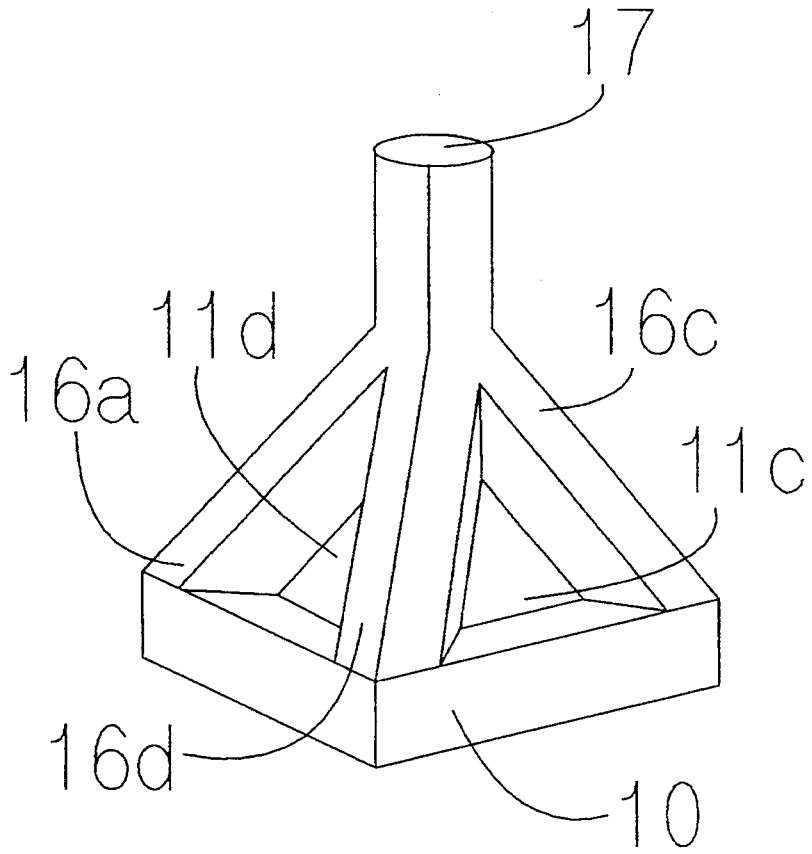
FIG. 1 shows a 3-D view of a single playing piece from an angle with no indicia present.

FIG. 1 represents a view of one possible type of playing piece which is displayed in such a fashion so as to best reveal the properties that make it unique. With a square base 10 provided as a method of aligning each piece. Surfaces 11*c* and 11*d* are provided to display indicia that will be visible to a limited number of players at any one time. Partitions 16*a*, 16*c* and 16*d* are provided to divide the playing piece into four sections and limit the visibility of indicia. In FIG. 1 and again in FIG. 2 there is an extension 17 provided to easily handle the playing piece.

Figure 2:
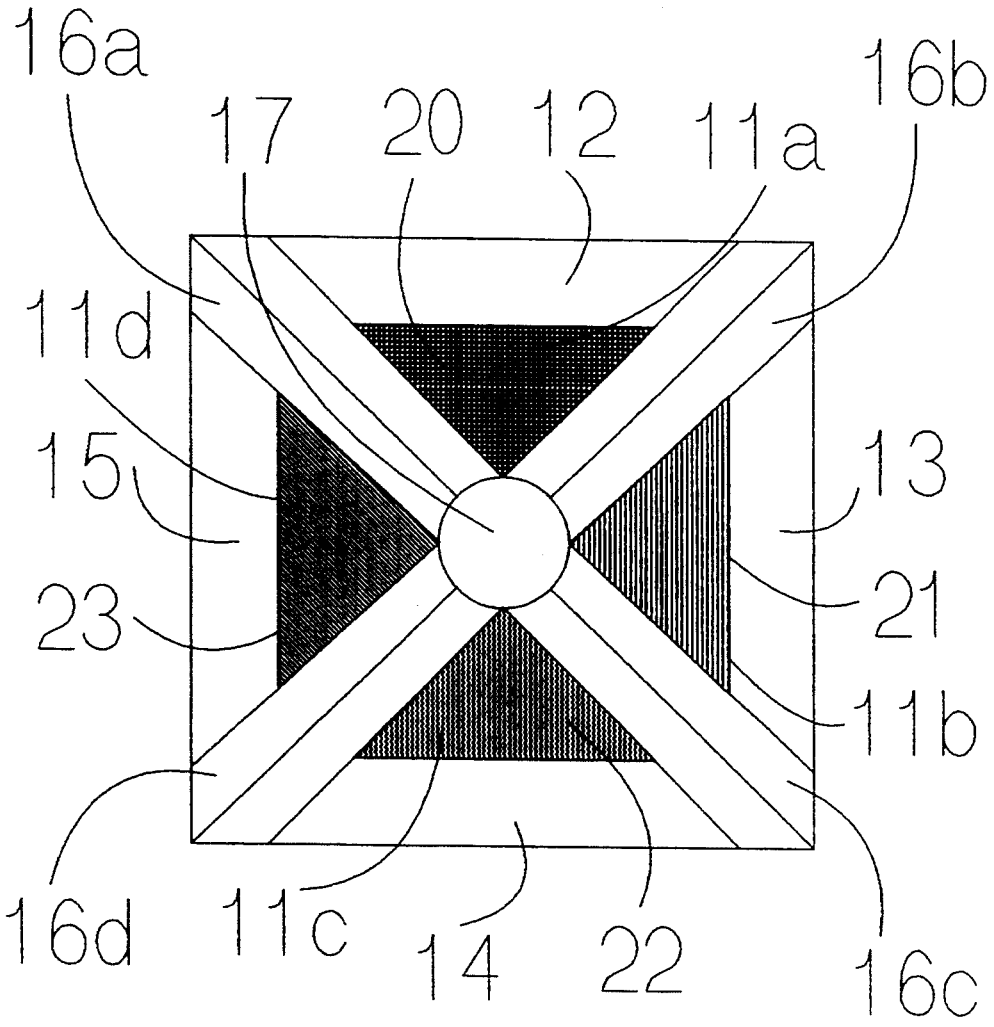
FIG. 2 shows a single playing piece from a plan view with one of the six possible patterns represented.

FIG. 2 represents a plan view of a single playing piece with each of the four concealed surfaces 11*a*, 11*b*, 11*c*, and 11*d* bearing a unique indicia 20, 21, 22, 23. The playing piece is divided into four distinct sections 12,13,14,15 by partitions 16*a*, 16*b*, 16*c*, and 16*d*. The playing piece represented in FIG. 2 is marked with indicia 20 on surface 11*a* in section 12 it is also marked with indicia 21 on surface 11*b* in section 13 with indicia 22 on surface 11*c* in section 14 and indicia 23 on surface 11*d* in section 15.

Figure 3:
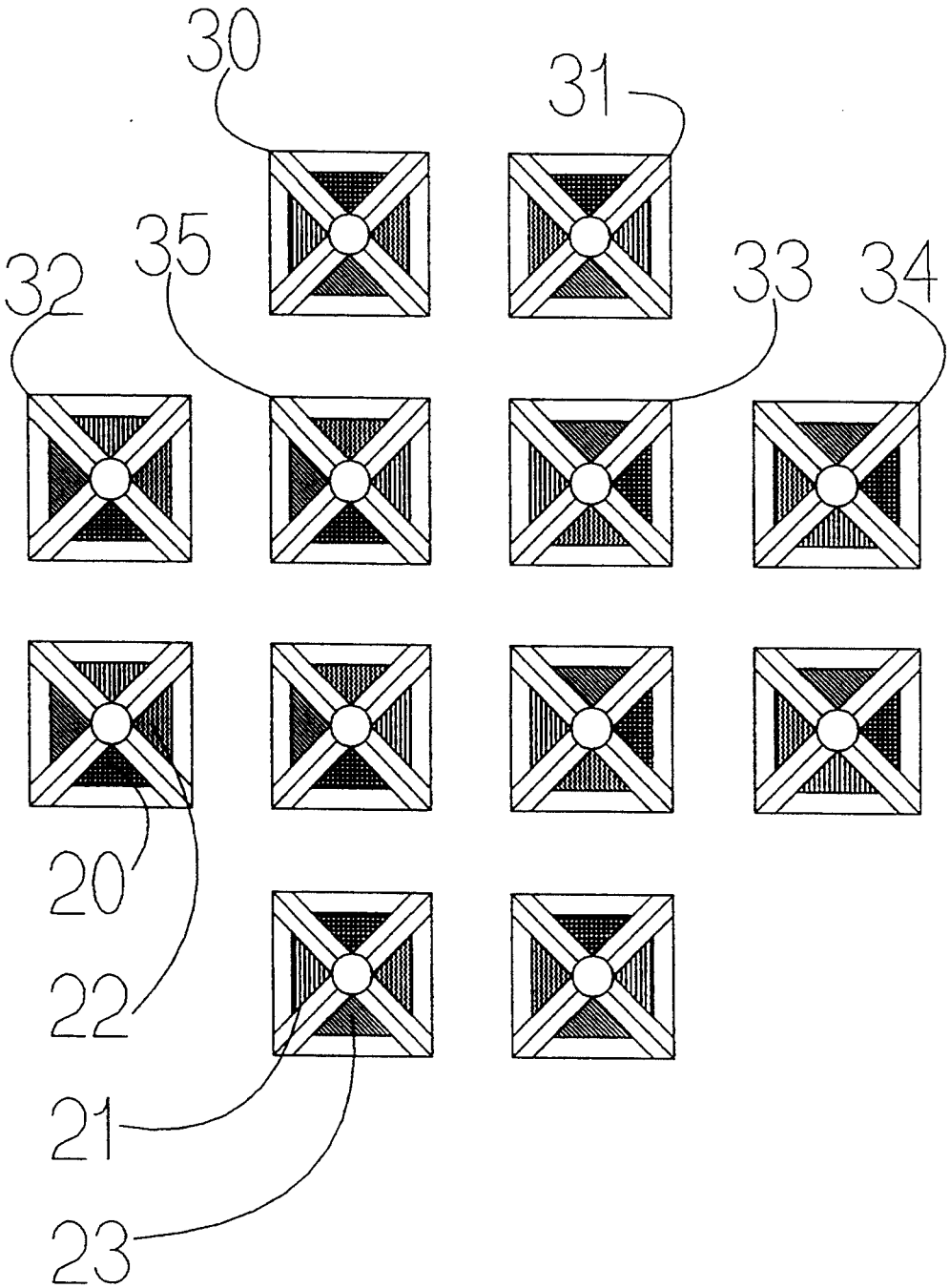
FIG. 3 shows a plan view of twelve playing pieces distributed on a flat surface with two playing pieces of each pattern being represented.

FIG. 3 represents a plan view of twelve playing pieces. With all six of the possible patterns 30, 31, 32, 33, 34, 35 of indicia 20,21,22,23 represented on two playing pieces of each type. A playing piece marked with pattern 30 is identified in the upper left position. A playing piece marked with pattern 31 is identified in the upper right position. A playing piece marked with pattern 32 is identified in the second row from the top in the far left position. A playing piece marked with pattern 35 is identified in the second row from the top and in the second position from the left. A playing piece marked with pattern 33 is identified in the second row from the top and in the third position from the left. A playing piece marked with pattern 34 is identified in the second row from the top and in the far right position. All of the patterns are duplicated on one other part that is also rotated in the same direction for ease of recognition. The rotation and or the position of all playing pieces will be determined by random distribution of the playing pieces at the time of play.

Figure 4:
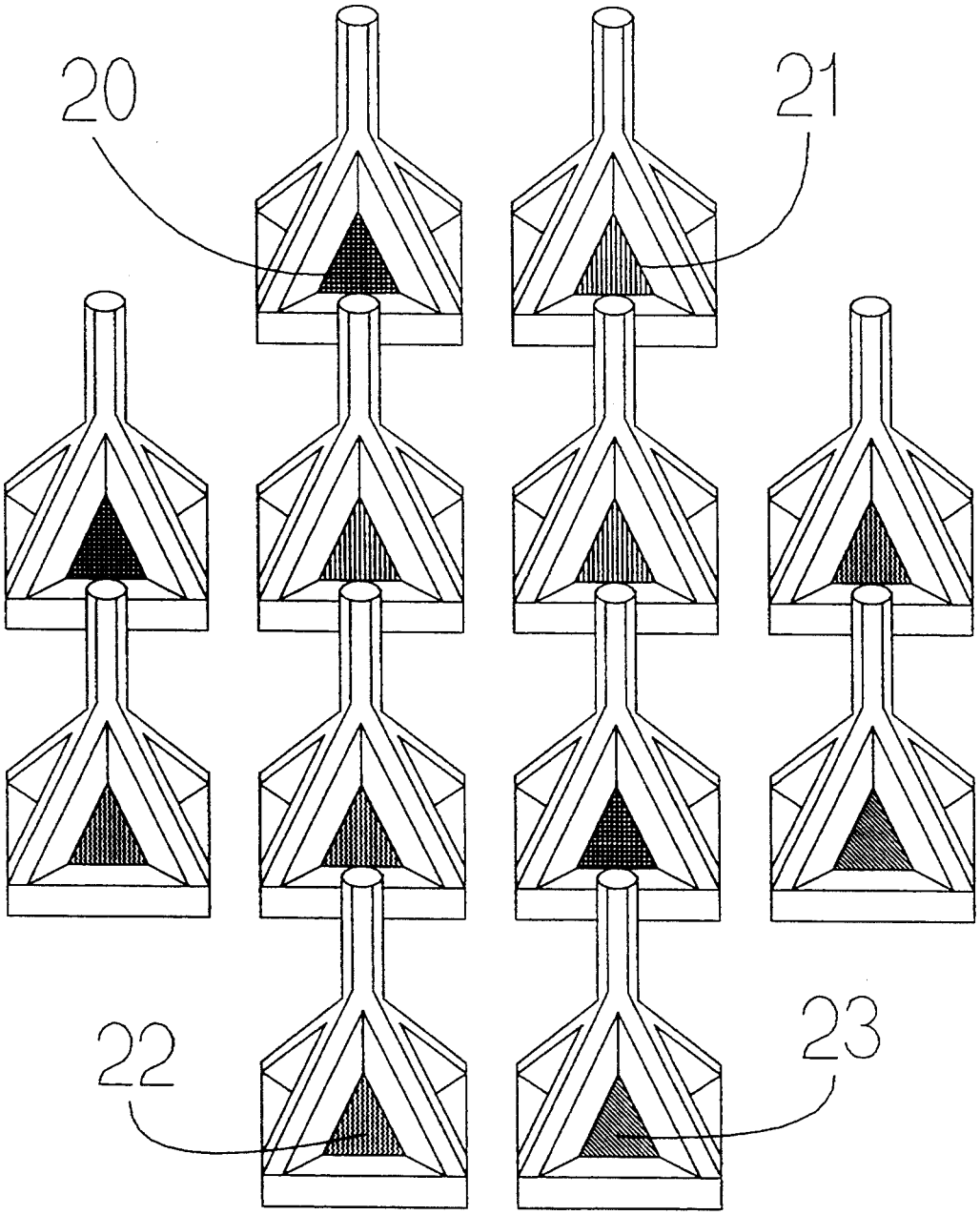
FIG. 4 shows twelve playing pieces distributed on a flat surface from one players perspective with only one indicia being visible on each piece.

FIG. 4 represents a comprehensive view of twelve playing pieces with indicia 20,21,22 and 23 being visible from one players perspective.

OPERATION OF FIGS. 1,2,3,4

The playing piece shown in FIG. 1 is designed so that only one of the concealed surfaces 11*c* and or 11*d* would be visible from any one playing position at a time. The partitions 16*a*, 16*c*, and 16*d* are designed to divide the playing pieces into four distinct sections. The square base 10 in FIG. 1 has been provided so that any number of playing pieces that are to be used can all be orientated in line with one another so as to have the same number of sides visible to each player. The extension 17 shown in FIG. 1 and again in FIG. 2 is provided as a way of lifting and rotating the playing piece easily without disturbing the other playing pieces. The playing piece shown in FIG. 2 is an example of one of six possible patterns of indicia 20,21,22,23. The playing piece can be physically rotated in increments of ninety degrees to align with other playing pieces. However, the indicia that will be visible will vary depending on the angle of rotation and the pattern on that playing piece. FIG. 3 shows a plan view of twelve playing pieces distributed on a flat surface in order to create an over all pattern of which only a portion will be visible to any of the players situated around the playing pieces. The function of the playing pieces is to display a different indicia 20,21,22,23 to each player. The purpose for the use of the six different patterns 30, 31, 32, 33, 34, 35 is so that no one player will be able to determine the indicia that the other players are viewing.

FIG. 4 shows the appearance of twelve playing pieces situated on a flat surface from one of four possible positions situated around the pieces. FIG. 4 shows the function of the partitions that restrict the view of indicia that are not situated facing each player. Also shown in FIG. 4 is each of the four indicia 20,21,22,23 made visible by the angle of the concealed surfaces within each section.

SUMMARY, RAMIFICATIONS, AND SCOPE

Accordingly, the reader should note that although the playing pieces and patterns represented upon them are the principal objects of the intended invention it is their function and usage which truly makes this game unique. The playing pieces are geometrically identical so as to be interchangeable with one another. The playing piece has also been designed so that they can be rotated in increments of ninety degrees with only one of the four indicia of the pattern visible at a time. The variety of patterns represented on the playing pieces is what will make not only the rotation of the piece important but also the position of each piece. Once all of the pieces have been distributed on a flat surface and each player has recorded the pattern of indicia visible to them, mixing and redistributing the pieces presents a challenge. A game of strategy arises when after redistribution of the pieces the players attempt to reproduce the previously recorded pattern. I have described one possible method of play in the following claims. However, this is intended as one possible embodiment of the current invention and should not limit the scope of the invention. The possible methods of play are numerous and the desired outcome can vary widely. Some of the major variations that I have considered involve the rotation of the playing pieces in relation to the players. With the playing pieces rotated at forty five degrees from the normal angle of play two sides of each playing piece will be visible to each player. I have also provided for an increased number of playing pieces to be used for a greater challenge. The game can be played requiring the pattern to be identical to the original, from either one players' perspective or all of the players' perspectives. The use of the game as a puzzle requiring all of the playing pieces to be returned to their original position and rotation with limited communication amongst the players could also prove to be entertaining.

I claim:

1. A set of individual four sided playing pieces of identical geometrical shape with a surface recessed within each of the four sides of said playing pieces upon which a single indicia is located, thereby making said indicia visible to not more than one player position at a time when a side of the piece faces a player position, with said single indicia being one of a set of four distinct indicia, with each of said indicia being represented only one time on each of said individual playing pieces, with said set of individual playing pieces being comprised of six different types distinguished by the position of said indicia in relation to one another on said individual playing pieces, thereby creating a unique pattern of said indicia visible to each player when said playing pieces are distributed on a flat surface.

2. A method of play wherein said set of playing pieces of claim 1 are distributed on a flat surface of sufficient size, said playing pieces being common property to all players, with a different pattern of indicia being visible to each player, with play proceeding in turn and each player attempting to duplicate a distinct and different predetermined pattern of indicia by either rotating one of said playing pieces in increments of ninety degrees or exchanging the position of any two of said playing pieces.

* * * * *